United States Patent [19]

Clowes

[11] Patent Number: 4,522,049

[45] Date of Patent: Jun. 11, 1985

[54] ALUMINUM ALLOY FOOD CAN BODY AND METHOD FOR MAKING SAME

[75] Inventor: Ernest J. Clowes, Lower Burrell, Pa.

[73] Assignee: Aluminum Company of America, Pittsburgh, Pa.

[21] Appl. No.: 475,164

[22] Filed: Mar. 14, 1983

[51] Int. Cl.[3] ..... B21B 45/00

[52] U.S. Cl. ..... 72/46; 72/349; 220/70; 220/72

[58] Field of Search ..... 220/83, 66, 1 BC, 72, 220/70; 72/347, 348, 349, 46, 47

[56] References Cited

U.S. PATENT DOCUMENTS

| | | | |
|---|---|---|---|
| 3,603,275 | 9/1971 | Eickenhorst | 113/120 |
| 3,730,383 | 5/1973 | Dunn et al. | 220/66 |
| 3,789,649 | 2/1974 | Clowes | 72/350 |
| 3,807,205 | 4/1974 | Vanderlaan | 72/4 |
| 3,855,862 | 12/1974 | Moller | 72/334 |
| 4,040,282 | 8/1977 | Saunders | 72/349 |
| 4,094,760 | 6/1978 | Smith et al. | 204/181 |
| 4,120,419 | 10/1978 | Saunders | 220/66 |
| 4,173,882 | 11/1979 | Lee | 72/349 |
| 4,320,848 | 3/1982 | Dye et al. | 72/349 |

*Primary Examiner*—Leon Gilden

*Attorney, Agent, or Firm*—Max L. Williamson

[57] ABSTRACT

An aluminum alloy food can body and a method of forming the same whereby an uncoated high strength aluminum alloy sheet stock is blanked and drawn into a sized cup and redrawn by one or more redraws to form the sized can body. The end wall of the can body is formed into a pressure resistant profile, the side wall adjacent the open end is trimmed and outwardly flanged, a plurality of annular beads is formed in a central portion of the side wall, and at least the interior of the can body is coated with a material compatible with the food product to be packaged in the can. An end portion of the can side wall is ironed to reduce its thickness during at least one of the redraw operations.

9 Claims, 5 Drawing Figures

ALUMINUM ALLOY FOOD CAN BODY AND METHOD FOR MAKING SAME

BACKGROUND OF THE INVENTION

The present invention relates generally to an aluminum alloy food can body and to a method for making such a can body from an uncoated aluminum alloy sheet, preferably a high strength aluminum alloy sheet. Even though aluminum is widely used in beer and other carbonated beverage can bodies, aluminum has heretofore not been extensively used in the manufacture of food can bodies. At least a part of the reason for the difference in usage of aluminum in the carbonated beverage and food can markets is related to differing strength requiremehts for food and carbonated beverage cans, and the effect the differing performance requirements have had on the opportunity to reduce the amount of aluminum needed to make a beverage or food can body.

A carbonated beverage can must be able to sustain an internal pressure from the $CO_2$ released from the beverage and must have sufficient column strength to withstand the axial load imposed upon the can side wall during double seaming to close and seal the open end of the can. The can must also have sufficient column strength to be reasonably handled and stacked during shipping and storing.

Dunn et al U.S. Pat. No. 3,730,383 is offered as being representative of many patents which describe a typical present-day aluminum carbonated beverage can and the method of making it. Typically, the can body is blanked and drawn into a cup from an uncoated metal stock approximately 0.012 inch to 0.014 inch thick. The cup is then drawn and ironed to reduce the side wall thickness to approximately 0.0045 inch to 0.0047 inch and to size the cup to the desired can body diameter. The bottom end wall is usually formed to a configuration suitable to accommodate the internal pressure, and the can body open end is trimmed and flanged to complete the process. It may be seen that a typical aluminum carbonated beverage can has a side wall thickness of only approximately 34 to 38% of the end wall or the metal feed stock, and thus a substantial amount of weight is reduced in the can and less metal is required to produce the can.

Such a can body or method of making it is not suited for making an aluminum food can body primarily because of the difference in the structural requirements of the food can which, in turn, results in a substantial difference in the side wall and end wall thickness relationship.

While a food can design is concerned with an internal pressure and column strength, as is the carbonated beverage can design, the food can design must also accommodate a negative pressure or vacuum within the can body after it is filled, closed and sealed. This concern for a vacuum in many food can uses results from the processing of the filled food cans. High internal vacuums are used in most cans filled with food products. A common method of food packing is to fill and seal the container and then heat the container in a retort, for example, for a specified time. The pressure inside the container increases as the filled food can is heated. A vacuum may result as the can cools after heating which has the effect of exerting an exterior pressure on the can. The external pressure acting upon the side wall of the can is referred to as a paneling pressure, and failure of the side wall to sustain the pressure is referred to as paneling. The minimum strength requirements of a food can, particularly as those requirements relate to internal pressure and vacuum, will vary with the food product and food processing conditions. Typically, however, in a conventional size aluminum food can, such as a 300×407 (3" O.D.×4 7/16" height), for example, the side wall and end wall will require substantially the same thickness to sustain the internal pressure, vacuum and column strength loads.

In many of the most common and widely used food can sizes and food can uses, the side wall is a critical structural element, and even though it can be stiffened by providing a plurality of annular beads in a central portion thereof, the thickness of the side wall controls or dictates the thickness of the aluminum food can feed stock. Since saving in metal by ironing and thinning the complete side wall is not available in making an aluminum food can, as is the case in making an aluminum carbonated beverage can, aluminum has not enjoyed widespread usage in the food can market.

For some can sizes, however, aluminum has been and is being used in making food can bodies. Small size cans having limited height to diameter ratios can be made from aluminum because the weight of the metal has less impact on the total cost of the can than if the can is large, and further, a precoated sheet can be used to make the can because only a limited amount of forming is required.

Usually a food can body is required to have an organic coating that is compatible with the food to be packaged on the interior of the can to protect the food from contamination. Precoating the aluminum sheet by roller coating, for example, before making small size can bodies has been advantageous because the cost of roller coating has generally been more economical than the cost of applying the coating by methods used heretofore, and further, the roller applied coating provided a higher degree of uniformity and integrity of coating than was available by other methods of coating, such as spray coating, for example.

Typically, precoated aluminum sheet has been used to make such small size food can bodies by drawing and redrawing a blank cut from roller coated coil stock.

Such a method is not economical, however, for making food cans which are larger and in general widespread use. To draw and redraw precoated material in making a food can, larger clearances are required between male and female tooling components to prevent the coating from being scratched, abraded or otherwise damaged. These larger clearances promote metal thickening in the upper section of the can body's side wall adjacent the open end and tapering away therefrom during drawing and redrawing to form the can body. Also as a part of the typical method of manufacture of a precoated aluminum food can body, a flange is provided on the first draw cup and is carried through subsequent redraws until the can body is formed to the desired diameter and height, at which point a marginal edge portion of the flange is trimmed away. It may be seen that this thickening in the upper side wall, flange area and trimmed portion requires an excess of metal to meet design requirements, thus significantly increasing the cost of metal in the can body and offsetting at least some of the advantage in using a precoated feed stock.

A can's cost is of considerable importance, since the cost may approach or exceed the cost of the packaged commodity. Therefore, any cost reduction in the container is desirable. Further, the desirability of aluminum as a packaging material has been well established in the carbonated beverage market. Among other advantages, aluminum is a readily recyclable metal, and its substantial use in the carbonated beverage market has fostered savings of raw materials, energy savings and reduction of litter.

It would be desirable, therefore, to provide an improved and economical method of making an aluminum food can in the most common and prevalent sizes.

SUMMARY OF THE INVENTION

This invention provides an improved aluminum food can body and a method for making such a body. In the practice of the method, uncoated aluminum alloy metal sheet, preferably a high strength aluminum alloy, is blanked and drawn to form a cylindrical cup having a side wall and a bottom end wall of a substantially uniform thickness. The cup is redrawn at least once to reduce the diameter to the diameter of the can body being made. A portion of the cup side wall adjacent to the open end thereof is ironed during redrawing to reduce the thickness of such portion and thereby reduce the weight and save metal required to make an aluminum food can body. In addition to thinning, ironing also extends the length of the thinned portion, and to the extent that the length is extended, the diameter of the blank required to make the can body can be reduced. A pressure resistant profile is formed in the bottom end wall of the redraw cup and a portion of the thinned metal adjacent the open end is trimmed away to provide a can body of predetermined length with a uniform edge thereon. The can body is outwardly flanged at the open end thereof to enable sealing the open end with a suitable can end by double seaming after the can has been filled. A plurality of annular beads are formed in a central, intermediate portion of the side wall of the can body to provide sufficient side wall strength. The interior surface of the can body is coated with a material suitable for contacting a product to be packaged in the can body, and the coating step can also include coating at least a portion of the exterior surface of the can body with the same or a different material to protect the exterior of the can from exposure to the environment. Preferably, the coating is accomplished by electrocoating with an electrophoretic material.

The sequence of the steps of trimming and flanging the side wall and forming the pressure resistant profile in the end wall of the redrawn can body is largely a matter of choice and no particular sequence is essential to the invention.

The present invention provides an improved aluminum alloy food can body. The food can body has a bottom end wall having a pressure resistant profile form therein and a side wall having an outwardly flanged open end integrally formed with the bottom end wall. The side wall has a first portion adjacent to the bottom end wall and a second ironed portion of lesser thickness than the first portion, the second portion including at least the outwardly flanged portion. A can body of the present invention may include a plurality of formed annular beads in a central area of the side wall.

Accordingly, an objective of the present invention is to provide a process for forming an aluminum alloy food can body having less weight than aluminum food can bodies have had heretofore.

A further objective of the present invention is to produce an aluminum alloy food can body using less starting material than has been necessary heretofore.

The above-mentioned and other objectives and advantages of the present invention will be more fully appreciated and understood by reference to the following description and drawings appended hereto.

DESCRIPTION OF THE PREFERRED EMBODIMENTS

Figure 1:
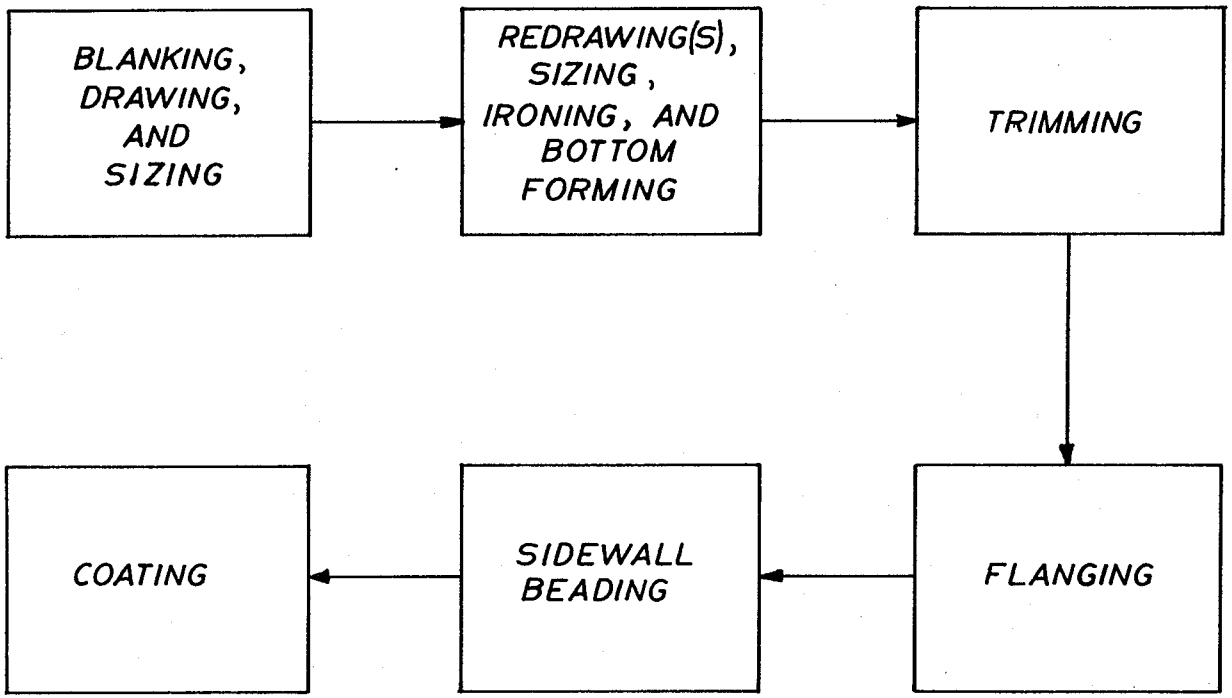
FIG. 1 is a flow diagram showing a preferred process of the present invention for making an aluminum alloy food can body.

Referring to the drawings, FIG. 1 illustrates a flow diagram for a preferred method of the present invention. For convenience, the method will be described with regard to making a 303×406 food can, but a method of making a food can body of this invention is not limited to any particular food can size. The steps of this method are referred to and discussed in the following paragraphs.

In the first step of the invention, uncoated aluminum alloy metal sheet is blanked, drawn and sized to form a cylindrical cup having an open end, a side wall and a bottom end wall. The words "sizing" or "sized" as used herein are words of common usage by those skilled in the art of making can bodies and refer to controlling the thickness without substantially reducing the thickness and/or controlling the uniformity of thickness of the side wall of a cup or partially formed can body during drawing and redrawing. It is to be understood that the expression "uncoated sheet" as used in the description of this invention is intended to mean a sheet having an as-rolled surface, but may also include a sheet having a lubricant coating suitable for use in forming a can body by a method of this invention. A high strength aluminum alloy, such as Aluminum Association Standard 5042 alloy, having an H19 temper, for example, is preferred in making a can body of this invention, but it is not intended that the scope of this invention is limited to any group, class or single aluminum alloy. A cup suitable for making a can body of this invention can be blanked, drawn and sized using tooling features and methods that are known to those skilled in the art, but the use of a double-action press is preferred for ease of fabrication.

Figure 5:
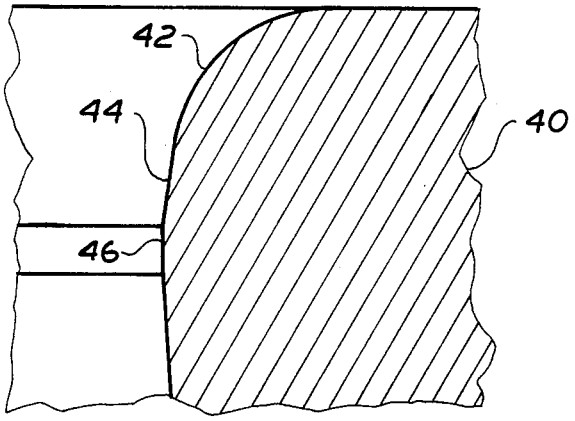
FIG. 5 is a sectional view of a fragmentary portion of a draw die used in the practice of this invention.

In addition to the use of a double-action press, there are preferred tooling design details and features to provide improved performance in forming a can body of this invention from a preferred high strength aluminum alloy such as 5042-H19. With reference to FIG. 5, the draw radius 42 on the cupping die 40 should be 10 to 12 times the thickness of the metal being drawn and should be well blended. If the radius is too small or is not properly blended, breakouts may occur. On the other hand, if the radius is too large, the metal will tend to wrinkle and higher than necessary pad pressures will be required to minimize the wrinkles. It is also desirable to provide a contour in the cupping die 40 similar to an ironing ring profile; that is, a tapered entry 44 and a narrow land 46 to help in reducing side wall scuffing, temperature buildup in the die and lower stripping pressures to remove the cup from the punch. An example of a suitable angle for a tapered entry is approximately 8°, and a suitable narrow land is 0.020 to 0.025 inch for a preferred draw die in the practice of this invention. Portions of the die which contact aluminum should be carbide and have a 2–4$\mu$ inch finish to avoid metal buildup on the surface.

The preferred nose radius on the draw punch used in making the cup is between 0.125 inch and 0.180 inch and should be well blended. A smaller radius may cause breakouts and an excessively large radius may contribute to forming buckles in the curved portion of the cup connecting the side and end wall.

During redrawing of a can body of this invention, as will be discussed later, an end portion of the can body is ironed to thin the metal and thus generate a savings in weight. In order to minimize the amount of metal that is lost as scrap when the can body end is trimmed after ironing and to minimize the amount of metal that must be ironed to thin the metal to its specified thickness, it is desirable that the side wall of the drawn cup be maintained in thickness as closely as possible to the thickness of the starting blank. It is preferred, therefore, in the practice of this invention to provide a clearance of approximately 1.075 times the nominal thickness of the blank. Such a clearance is reasonably practical to maintain without seriously interfering with production of the can body. In addition to sizing the cup side wall, providing a minimal clearance between the drawing tools aids in reducing the amount of earing on the rim of the cup.

An additional preferred tool feature that is useful in reducing earing on the cup is to provide a plurality of annular grooves in the surface of the blank holder or the draw die, as shown in Clowes U.S. Pat. No. 3,789,649, for example. By reducing the tendency for earing, it may be possible to use lower pad pressures than might otherwise be required in drawing the cup.

The draw reduction in forming a cup from a preferred high strength aluminum alloy should usually not exceed 40%. Reductions in excess of 40% may increase earing, strain line severity, pad pressures and downtime in production due to breakouts. The thickness of the metal sheet and the blank diameter in forming the cylindrical cup are dependent upon the final dimensions of the desired can body, the aluminum alloy from which the can body is to be fabricated and the loads which the can is required to sustain. For a 303×406 5042-H19 aluminum alloy food can of the present invention, to withstand a minimum internal pressure of 40 psi, a minimum external pressure of 23 psi and a minimum column load of 525 lbs., the beginning metal stock thickness is 0.009 inch and the blank diameter is 8.288 inches.

The next step after blanking and drawing is redrawing the cylindrical cup at least once to lengthen the side wall and reduce the diameter thereof to the diameter of the can body being made. During redrawing, the side wall of the cup is further sized to control its thickness. The total number of redraws needed and the draw reduction required for each redraw are dependent upon the final dimensions of the desired can body and the forming characteristics of the aluminum alloy. As is the case in drawing the cup, the use of a double-action redraw press is preferred for ease of fabrication.

The foregoing redrawing step or steps in making a food can body of this invention also include ironing a portion of the cup side wall adjacent the open end thereof to thin such portion and thereby reduce the amount of metal required to make the can. Ironing of such a top portion may be performed while making any of the separate redraws if multiple redraws are required to make the desired can body size. It is preferred that when two or more redraws are required the ironing be performed in the last of the redraws.

Sizing of the side wall during redrawing is accomplished in essentially the same manner as sizing during drawing; that is, the clearance between the redraw punch and die is tightly controlled. Preferred clearances depend upon the thickness of the metal in the cup side wall and the 303×406 food can from 5042-H19 aluminum in accordance with this invention requires a metal blank thickness of 0.009 inch, a first draw and two redraws. The drawn cup produced in the first draw has a side wall which varies in thickness from 0.009 inch adjacent the bottom to approximately 0.0097 inch adjacent the open end since the clearance between the draw punch and die is 1.075×0.009 inch or approximately 0.0097 inch. In the first redraw, the cup is reduced in diameter approximately 25%, and the clearance between the punch and die should be adjusted to maintain the wall thickness achieved during cupping. The clearance, therefore, should be substantially the same as that used in drawing, or 0.0097 inch, and the resultant wall thickness of the redrawn cup varies from approximately 0.0097 inch adjacent the open end to approximately 0.0088 inch near the bottom. It may be noted that a slight tapering reduction in thickness of the side wall takes place from the top to the bottom as a result of a typical draw or redraw operation.

Figure 2:
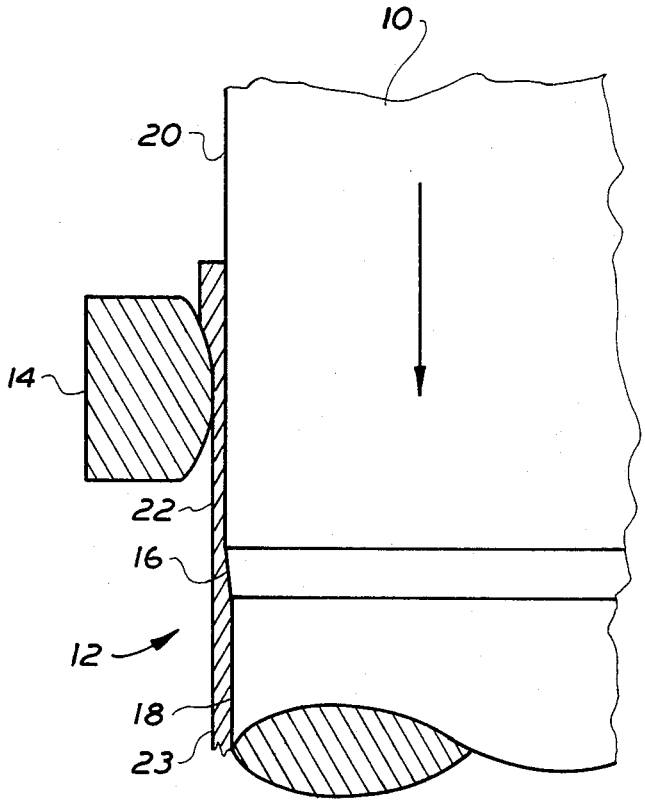
FIG. 2 shows a fragmentary view of a portion of a redraw punch and a section through one half of an ironing ring and showing the side wall of the cup adjacent its open end which is being ironed between the ironing ring and the punch.

During the second redraw, the can body is reduced approximately 18% to its finished diameter, a portion of the side wall near its open end is thinned by ironing, and the remainder of the side wall is sized to its final thickness. Referring now to FIG. 2, redraw mandrel or punch 10 with a partially formed cup 12 on it is shown near the end of its stroke through a drawing-ironing ring 14 in the direction of the arrow. Redraw punch 10 has an outwardly tapering frustoconical surface 16 extending from a first portion 18 of the punch to a second portion 20 having a greater diameter than the first portion and thereby causing an end portion 22 of the cup side wall to be thinned and extended in length as it is ironed in passing between the drawing-ironing ring 14 and the larger diameter punch portion 20. To produce the redrawn and sized side wall portion 23 of the can body for the heretofore mentioned 303×406 food can, the clearance between the first punch portion 18 and the drawing-ironing ring 14 is maintained at a value equal to the thickness of the first redrawn cup near the bottom, which is 0.0088 inch. Redrawing using such a tooling clearance produces a redrawn and sized wall portion 23 having a substantially uniform thickness of 0.0088 inch. The clearance between the second punch portion 20 and drawing-ironing ring 14 is reduced 0.0008 inch to produce the ironed and thinned wall portion 22 near the open end of the can body 12.

At least the portions of the can wall that are trimmed and flanged may be ironed and reduced in thickness to effect a savings in metal, but an additional length of side wall below the flanged portion may also be ironed depending upon the can size and the structural requirements of the can wall.

As has been noted heretofore, the critical loads on the side wall are the column load and the external or paneling pressure. The ability of the side wall to sustain such loads is a function of its thickness, its height and the extent and configuration of annular bead stiffening. For a given size can, therefore, such as a 303×406 can, for example, the specific amount of reduction in thickness and lineal extent of such thinned portion will vary substantially depending upon the load requirements specified by the food packager.

Figure 3:
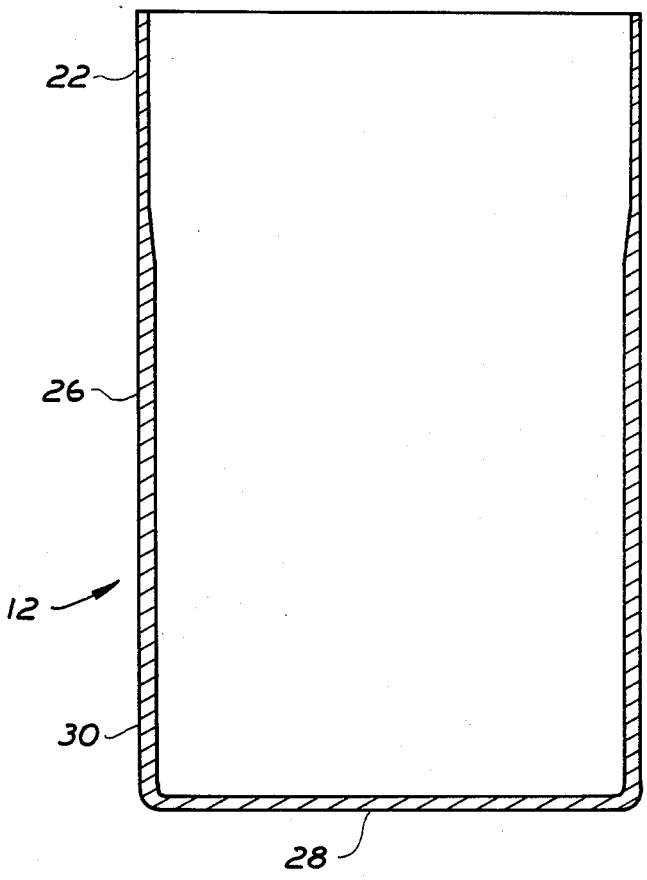
FIG. 3 shows a sectional view of a can body after drawing, redrawing and ironing of the top end of the side wall.

FIG. 3 shows a can body at the completion of the redrawing step and partial ironing of the side wall in a preferred method of the present invention. The can body 12 has a side wall 26 integral with a bottom end wall 28. The side wall 26 has a first portion 30 adjacent the bottom end wall 28 and a second portion 22 having a thickness less than the first portion 30 and extending away from the first portion 30.

Figure 4:
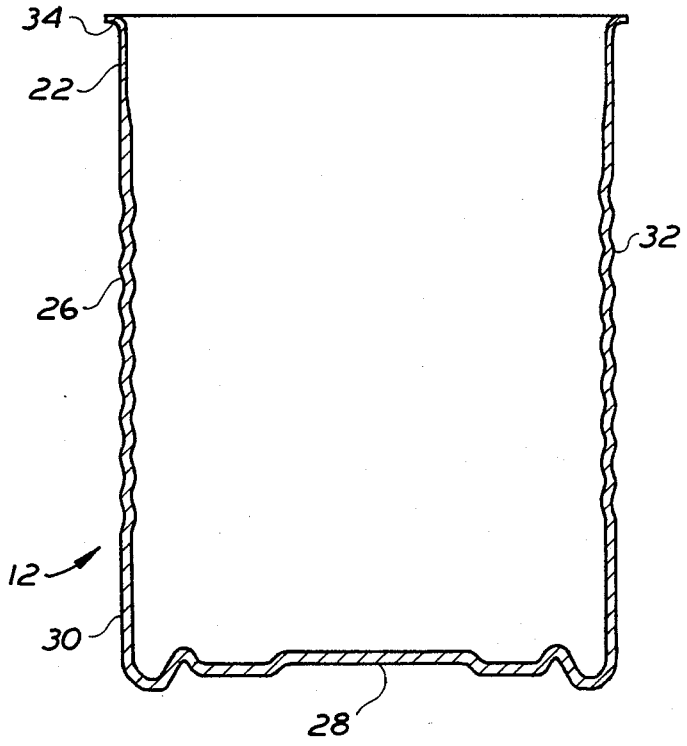
FIG. 4 shows a sectional view of a can body of the present invention which has been bottom formed with a pressure resistant profile, trimmed, flanged and side wall beaded.

After redrawing the cup and ironing a portion of the side wall, the bottom end wall of the cup is formed to produce a pressure resistant profile to permit the bottom end wall to flex in response to internal or external pressures without permanent distortion, thus strengthening the bottom end wall without resorting to increasing the metal's thickness. The particular profile is a function of the alloy, the size of the can and the magnitude of pressures that the can must sustain. Preferably, the redrawing step includes the step of forming such a profile in the bottom end wall for economical reasons. While any number of pressure resistant profiles known in the art can be used, an example of a pressure resistant profile is shown in FIG. 4 in the bottom end wall 28.

A food product is generally sealed in a can by attaching a can end to the can body by a well-known method referred to as double seaming. To provide a double seamed bead comprised of marginal portions of the can body and the can end interlocked together by rolling, an outwardly projecting flange adjacent the open end of the can body must be provided.

Through drawing, redrawing and ironing a portion of a blank to fbrm a can body of the present invention, a portion of the thinned side wall adjacent the open end is irregular or uneven and must be trimmed away to enable forming a suitable flange for double seaming, as well as to provide a can body of predetermined length with a uniform edge on the side wall defining the open end. FIG. 1 shows such trimming prior to forming an outwardly flanged portion, but it is to be noted that the sequence of trimming and flanging could be reversed if the can body were ironed during a redraw other than the last redraw. In such a case, it would be possible to provide the flange while making a subsequent redraw and then trim.

A plurality of annular beads 32 (FIG. 4) are formed in a central, intermediate portion of the side wall of the can body by using a can beader and method such as that described in Vanderlaan U.S. Pat. No. 3,807,205, for example. Such forming of beads is commonly referred to in the art as side wall beading. Side wall beading strengthens the can body's side wall, thereby permitting the use of a thinner metal in the side wall than would otherwise be required for providing paneling resistance to external pressure. The number and configuration of annular beads required to be formed in the can body's side wall can vary, depending upon the particular external pressure requirements, and the alloy and thickness of the side wall of the desired can body. An example of a can body of the present invention which has a beaded side wall is shown in FIG. 4.

The final step in the method of the present invention to make an aluminum food can is coating the interior surface of the can body with a material suitable for protecting the interior of the can from corrosion and protecting the food product from contamination. If desirable, the coating step can also include coating at least a portion of the exterior surface of the can body with the same or a different material suitable for protecting the exterior of the can from corrosion or other adverse effects from a particular environment, such as heavy oxidation in the humid, elevated temperature of a cooking retort used to heat the filled food can, for example. The coating step includes any preparatory cleaning of the surface or surfaces. Coating can be accomplished by any of various methods known to those skilled in the art. For reasons of economy and uniformity of coating, however, it is preferred that coating be accomplished by electrocoating using an electrophoretic coating material. An example of an electrocoating method and apparatus which can be used in the practice of the present invention in coating both the can body's interior and exterior is described in U.S. Pat. No. 4,094,760 to Smith et al.

By referring to FIG. 4, the following example is an aluminum food can in accordance with a method of the present invention versus making a similar food can by a heretofore known method.

FIG. 4 shows a food can body of 5042-H19 aluminum alloy suitable for combining with a can end to produce a 303×406 food can as described in the foregoing description of a preferred embodiment of this invention. The can body 12 is comprised of a profiled pressure resistant bottom end wall 28 and a substantially cylindrical beaded side wall 26 integral with the profiled bottom end wall 28. The side wall 26 includes a first portion 30 extending upward from the bottom end wall and a second portion 22 of lesser thickness than the first portion 30 extending from the first portion to the open end of the can body. A flange 34 projects outwardly from the side wall adjacent the open end for double seaming purposes.

As noted heretofore, 0.009 inch 5042-H19 aluminum alloy having a typical yield strength of 48 ksi and tensile strength of 50 ksi was determined to be of suitable strength to make a can body to combine with a can end to make a 303×406 food can. The profiled bottom end 28 is substantially 0.009 inch thick and the first side wall portion 30 is substantially 0.0088 inch thick reflecting a very slight reduction in thickness during draw and redraw but remaining substantially the same thickness as the bottom end wall. The thinner second side wall portion 22 and outwardly flanged portion 34 are substantially 0.0080 inch and the linear extent of the thinned wall portion and outwardly flanged portion is approximately 1¼ inches. The net weight of the just described uncoated can body of this invention is 43.75 lbs/M and the gross weight of the metal required to produce such a can body is approximately 53.38 lbs/M.

In contrast, a food can body suitable for making a 303×406 aluminum food can made from precoated aluminum material by a known method, as discussed heretofore in the background description of this specification, would start, for example, with 0.009 inch 5042-H19 aluminum alloy. Such a food can body thus formed would have a profiled bottom end wall identical to the bottom end wall shown in the can body of FIG. 4 having a thickness substantially the same as the starting material. The thickness of the side wall of such can body will vary from approximately 0.0088 inch thick near the bottom end wall to approximately 0.0120 inch thick near the open end. The net weight of such a can body, excluding the weight of the coating material, would be approximately 46.37 lbs/M, and the gross weight, excluding coating weight, of the metal required to produce such a can body would be approximately 54.87 lbs/M.

It may be seen, therefore, that the gross weight of metal for making such a can body of this invention is approximately 6.04% less than the gross weight of metal used in making a can body by such known method. Such savings in metal is substantial with a concomitant cost savings, especially when the manufacture of millions of such aluminum food can bodies of the present invention is considered. Further, because a portion of the side wall of such uncoated can body of the present invention is thinned, such can body would weigh approximately 5.65% less than a can body formed by such known method. It may be seen that a can body of this invention offers additional savings in lower shipping costs when compared with aluminum cans made by known methods or typical steel food cans.

While the invention has been described in terms of preferred embodiments, it will be apparent to those skilled in the art that many modifications of the invention are possible without departing from the scope thereof and would be within the invention as defined in the claims hereto appended.

What is claimed is:

1. A method for making an aluminum alloy food can body having a flanged open end for sealing with a can end by double seaming, comprising the steps of:

blanking and forming at least one cylindrical cup from an uncoated aluminum alloy sheet, said cup having a side wall, an open end, and a bottom end wall;

reforming said cup at least once to lengthen the side wall and reduce the diameter thereof, and concurrent therewith, ironing a portion of the cup side wall adjacent the open end thereof to thin said portion to a thickness less than the thickness of the side wall portion extending from the ironed portion to the bottom end wall, said ironed portion including at least the portion to be flanged;

forming a pressure resistant profile in the bottom end wall of said cup;

trimming a portion of the ironed portion adjacent the open end of the reformed cup to provide a can body of predetermined length with a uniform edge on the side wall defining the open end;

outwardly flanging a portion of the side wall adjacent the open end of said trimmed can body;

forming a plurality of annular beads in a central, intermediate portion of the side wall of said can body; and coating at least the interior surface of said can body with a material suitable for contacting a product to be packaged in said can body.

2. The method of claim 1 wherein the coating is accomplished by electrocoating.

3. The method of claim 1 which further includes coating at least a portion of the exterior surface of the can body.

4. The method of claim 1 which includes a plurality of redraws.

5. The method of claim 4 wherein said ironing is performed in the last of the plurality of redraws.

6. The method of claim 1 which further includes sizing the side wall while drawing.

7. The method of claim 1 which further includes sizing the side wall while redrawing.

8. The method of claim 1 which further includes drawing said cup by using a draw die having a draw radius of 10 to 12 times the thickness of metal being drawn.

9. The method of claim 1 which further includes drawing said cup by using a draw die having a tapered entry and a narrow land.

* * * * *

UNITED STATES PATENT AND TRADEMARK OFFICE

CERTIFICATE OF CORRECTION

PATENT NO. : 4,522,049

DATED : June 11, 1985

INVENTOR(S) : Aluminum Alloy Food Can Body and Method for Making Same

It is certified that error appears in the above-identified patent and that said Letters Patent are hereby corrected as shown below:

| | |
|---|---|
| Col. 1, line 16 | Change "requiremehts" to --requirements-- |
| Col. 6, line 21 | After "and the", insert --number of redraws being employed. For example, to make a-- |
| Col. 7, line 47 | Change "fbrm" to --form-- |
| Col. 8, line 31 | After "example is", insert --offered to illustrate the metal savings available in making-- |

Signed and Sealed this

*Eighth* Day of *October 1985*

[SEAL]

*Attest:*

*Attesting Officer*

DONALD J. QUIGG

*Commissioner of Patents and Trademarks—Designate*